United States Patent [19]

McCullough, Jr. et al.

[11] Patent Number: 4,979,274

[45] Date of Patent: Dec. 25, 1990

[54] PROCESS AND APPARATUS FOR CRIMPING FIBERS

[75] Inventors: Francis P. McCullough, Jr.; Robert T. Patton, both of Lake Jackson; R. Vernon Snelgrove, Damon, all of Tex.

[73] Assignee: The Dow Chemical Company, Midland, Mich.

[21] Appl. No.: 340,098

[22] Filed: Apr. 18, 1989

[51] Int. Cl.[5] ..... D02G 1/00; D02G 1/14; D02G 1/08; D02J 1/00

[52] U.S. Cl. ..... 28/278; 28/279; 28/280; 28/247; 28/249; 19/66.1; 19/66.2

[58] Field of Search ..... 28/278, 279, 280, 247, 28/249; 19/66.1, 66.2; 223/30, 31, 32

[56] References Cited

U.S. PATENT DOCUMENTS

| | | | |
|---|---|---|---|
| 951,863 | 3/1910 | Wessel | 19/66.2 |
| 1,168,171 | 1/1916 | Crumbaugh | 28/279 |
| 1,904,030 | 4/1933 | Post | 223/32 |
| 1,918,284 | 7/1933 | Mitchell | 223/30 |
| 2,245,874 | 6/1941 | Robinson . | |
| 2,508,489 | 5/1950 | Browne et al. | 19/66.2 |
| 2,623,266 | 12/1952 | Hemmi . | |
| 2,668,564 | 2/1954 | Laros | 28/279 |
| 2,696,034 | 12/1954 | Swartz | 28/280 |
| 3,348,283 | 9/1967 | Stanley | 28/249 |
| 3,348,993 | 9/1967 | Sissons | 28/247 |
| 3,765,818 | 9/1973 | Migazaki | 28/279 |

FOREIGN PATENT DOCUMENTS

| | | | |
|---|---|---|---|
| 661613 | 3/1965 | Belgium | 28/279 |
| 4533377 | 11/1967 | Japan | 28/279 |

*Primary Examiner*—Werner H. Schroeder
*Assistant Examiner*—Bibhu Mohanty

[57] ABSTRACT

An apparatus for crimping and permanently heat setting a fiber or tow without stress or tension, comprising a mechanical crimping means, a conveying means which receives the crimped fiber or tow, and a heating or irradiation zone through which the conveying means and fiber or tow passes.

13 Claims, 3 Drawing Sheets

FIG. 1
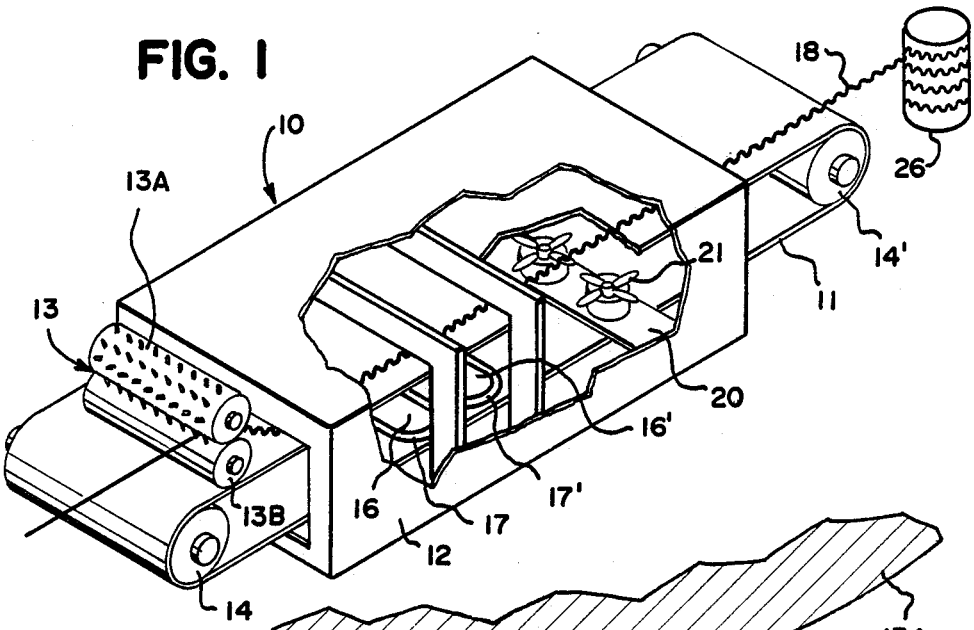
FIG. 2
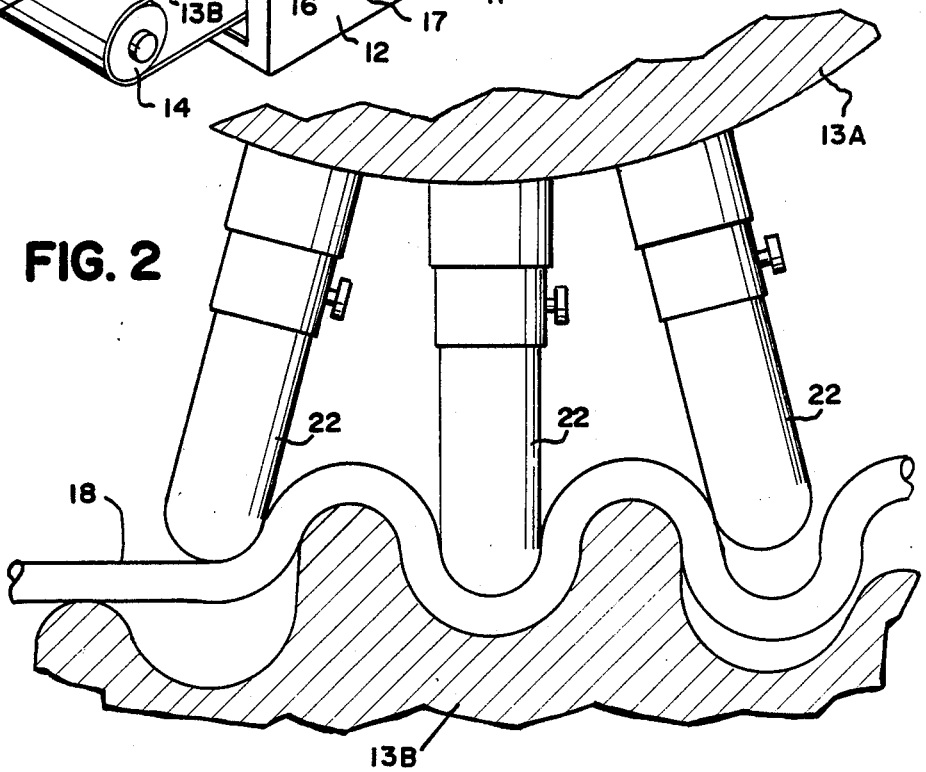
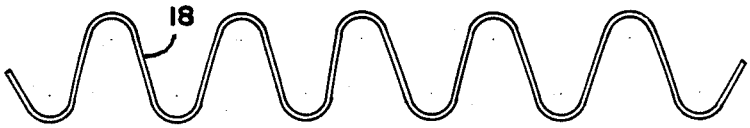
FIG. 3

PROCESS AND APPARATUS FOR CRIMPING FIBERS

FIELD OF THE INVENTION

The present invention relates to an apparatus and method for providing fibers with non-stressed crimps which does not utilize a knit/deknit step. More particularly, the invention relates to a method and apparatus for providing a crimp to inorganic or polymeric fibers by placing a temporary crimp in the fibers or tow and then heat treating or irradiating the fibers or tow without subjecting the fibers or tow to stress or tension. The apparatus is especially useful to produce crimped fibers utilizing large sized tows (about 40K–320K) as precursors. The crimped fibers formed by the present apparatus when dyed possess good dye uniformity.

BACKGROUND OF THE INVENTION

Crimp can be defined as the non-linearity in fiber. For most of the man-made fibers employed in carpet manufacture, the crimp or bend in the fiber is induced by thermal/mechanical techniques. It can also be thought of as the difference between the non-linear (crimped) fiber and the straightened fiber (fiber extended). Crimp is important in carpet fibers because it provides bulk to the yarn by preventing two fibers from laying parallel to one another. As a result, the carpet tuft will have greater covering power, appear softer, and give better resistance to wear and abrasion, among other benefits.

Crimp is also useful in the processing of staple fibers. Crimp is particularly useful in the processing of high modulus fibers which are difficult to work with because of slipperiness.

The crimp for most carpet fibers is inserted in the fibers using a stuffer box method and is rarely as uniform. The stuffer box technique produces fibers having a wavy, random zig-zag type crimp which is sharp and V-shaped. The randomness of the crimp which is obtained would seem to cause the fiber to appear to have a nonuniform crimp; however, if several fibers are viewed simultaneously, it can be seen that the crimp produced by this method is regularly irregular.

Crimp in the stuffer box is achieved by passing yarn(s) or tow(s) into a uniformly heated chamber which is at the temperature required to heat set the fibers in their crimped or non-linear configuration. As the yarns are forced into the chamber be feed rolls, it pushes against yarn which is already in the chamber, thereby causing the filaments to bend and buckle (crimp).

A weighted tube fitted into the top of the stuffer box governs the flow and quantity of yarn into the stuffer box. The frequency (crimps per inch) and the crimp amplitude of the fibers are controlled by regulating the speed of the feed rolls to that of the take up rolls as well as the weight of the tube. Crimp setting by these techniques can be done for single filaments or on multiple ends (tow) using a spunize technique. The crimps are generally characterized by numerous sharp bends.

In order to obtain crimp the fiber must undergo bending. During bending two types of stress modes are developed simultaneously. There is a tensile stress along the outer curvature of the fiber, while a compressive stress is acting on the inner portion of the bend.

A recent study of the affects of crimp on polyester fiber showed that severe bending (example, V-type crimp) can result in extensive fiber damage. Even the rounded V-type fibers have compression ridges on the underside of the crimp, while severely crimped fibers (V-type bends) failed due to compressive forces operating within the fiber. The result is a weaker fiber. It has also been found that such overcrimped fibers tend to take up dye preferentially on the underside of the bend and can be the cause for optical streaking in the resulting yarn. This comes about because the knee of the bend projects toward the surface of the yarn and hence are more visible to the eye. Since they will contain more dye the affect is a dark optically appearing streak. At the same time, because the dye tends to concentrate at these points, the remaining fiber tends to be deficient in dye and appear lighter.

It has been shown that crimp permanency after loading can differ between fiber producers and even among various types (e.g., bright and semidull) made by the same producer. Since some tension on fibers and yarn inevitably attends normal fiber processing it is to be expected that some loss in crimp definition will likely occur. This loss must be near identical from spindle to spindle, twister to twister, etc. otherwise the yarns will appear to be different since crimped fibers differ in appearance from uncrimped fibers as a result of the reduced-bulking factor. At the same time some fiber elongation is obtained during crimp removal which would tend to order the fiber microstructure. This could influencing dyeing since a more ordered microstructure will take up dye differentially than fibers which have not undergone any elongation.

U.S. patent application Ser. No. 112,353 of McCullough et al, which is herein incorporated by reference, discloses one method for preparing novel non-linear carbonaceous fibers having physical characteristics resulting from heat treating stabilized polymeric fibers in the form of a fabric. There is described a process wherein the fabric is substantially irreversible heat set under conditions free of non-uniform stress and tension. In order to obtain fibers which are non-linear, it is necessary to deknit the fibers. Knitting and then deknitting the fabric to obtain non-linear carbonaceous fibers increases the cost in producing the fibers.

U.S. Pat. No. 2,245,874 to Robinson, discloses a method for forming curled fiber material by passing fibers over cold rollers under conditions to bend and stretch the fibers beyond elastic limits. Such a process cannot be used to produce non-linear fibers with the physical properties found in the fibers produced by the present invention.

U.S. Pat. No. 2,623,266 to Hemmi discloses the mechanical preparation of sinusoid or spiraloid crimped fibers. The fibers are heated and passed through a series of bars which impart a meander-like crimp. However, the fibers are formed in a crimped and stretched state.

It is desirable to provide a relatively inexpensive and simple method for producing non-linear fibers and tows.

It is further desirable to provide a method for producing non-linear fibers which does not require the prior formation of a fabric.

It is also desirable to prepare non-linear carbonaceous fibers without performing a knit-deknit operation.

It is still further desirable to providing a crimping process which does not produce a non-uniformly dyed fiber.

SUMMARY OF THE INVENTION

The present invention is directed to a method and an apparatus for producing non-linear permanently heat setting glass, ceramic or polymeric fibers without non-uniform stress or tension. Advantageously, the apparatus can be utilized to produce carbonaceous polymeric fibers without a knit/deknit step. The apparatus comprises a means for gear crimping a fiber or tow, preferably at a temperature of between about 100°to 250° C. A conveying means is provided to receive the crimped fiber or tow and transport it without tension or stress through one or more heating zones. The heating zone may comprise one or more heating units. One heating unit may comprise a fiber oxidation or stabilization zone. Another heating unit may comprise a heating means for substantially irreversibly heat setting the fiber in an inert atmosphere.

In a preferred operation, the fiber (filament) or tow filaments is passed through an apertured rounded gear crimper wherein a temporary crimp is imparted to the fiber or tow. Preferably the crimper is heated so as to soften the fiber or two. The crimped fiber or tow is placed in a relaxes and unstressed state on a conveyor where it is transported through a heating zone at a temperature and rate to heat set and/or carbonize the fiber or two. The tows may comprise fibers of about 40 to 320K.

The fibers or tows utilized with the apparatus of the invention may comprise any inorganic or polymeric material capable of being heat set. Preferably, the polymeric fibers are the high performance fibers such as oxidized acrylic fiber (OPF), aramids, PBI, etc. The apparatus is particularly suited to prepare the non-linear carbonaceous fibers disclosed in said application Ser. No. 112,353.

It is therefore an object of the invention to provide an apparatus and a process which can prepare non-linear carbonaceous fibers without utilizing a knit/deknit operational step.

It is a further object of the invention to provide a crimped fiber having improved dyeability characteristics because of the absence of sharp bends.

Other objects and a fuller understanding of the invention will be had by referring to the following description and claims of a preferred embodiment, taken in conjunction with the accompanying drawings, wherein like reference characters refer to similar parts throughout the several views.

BRIEF DESCRIPTION OF THE DRAWINGS

FIG. 1 is a perspective view, partly in section disclosing a crimping apparatus of the invention;

FIG. 2 is an elevational view showing a section of the crimping unit of FIG. 1;

FIG. 3 illustrates a uniformly crimped fiber prepared by the apparatus of the invention;

DESCRIPTION OF THE PREFERRED EMBODIMENTS OF THE INVENTION

Figure 4:
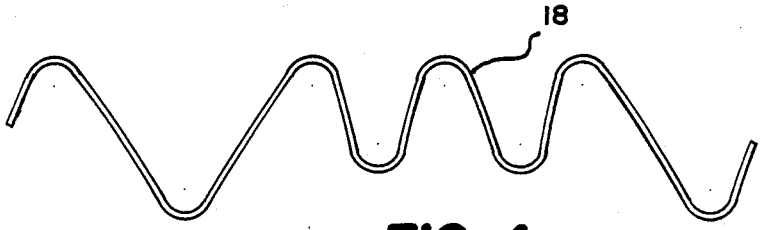
FIG. 4 illustrates a non-uniformly crimped fiber prepared by the apparatus of the invention.

Although specific terms are used in the following description for the sake of clarity, these terms are intended to refer only to the particular structure of the invention selected for illustration in the drawings, and are not intended to define or limit the scope of the invention.

As seen in FIG. 1, the apparatus of the invention 10 comprises an endless conveying belt 11 which travels around drive rolls 14, 14' through a closure 12. The closure 12 may comprise one or more compartments for heating and/or cooling. For example, there is provided heating chambers 16, 16' with heaters 17, 17' through which a fiber or tow 18 passes and is cooled in chamber 20 with cooling fans 21. The fiber or two 18 is first passed through a heated crimper 13 comprising crimp rolls 13A, 13B where the fiber or tow 18 is made pliable and provided with a temporary crimp. After passage through the closure 12 the fiber or tow 18 is taken up on take-up roll 26. In operation the fiber or two 18 is placed in a crimped state on the conveyor belt 11 so as to be in an unstressed state and without tension during heat setting.

Figure 7:
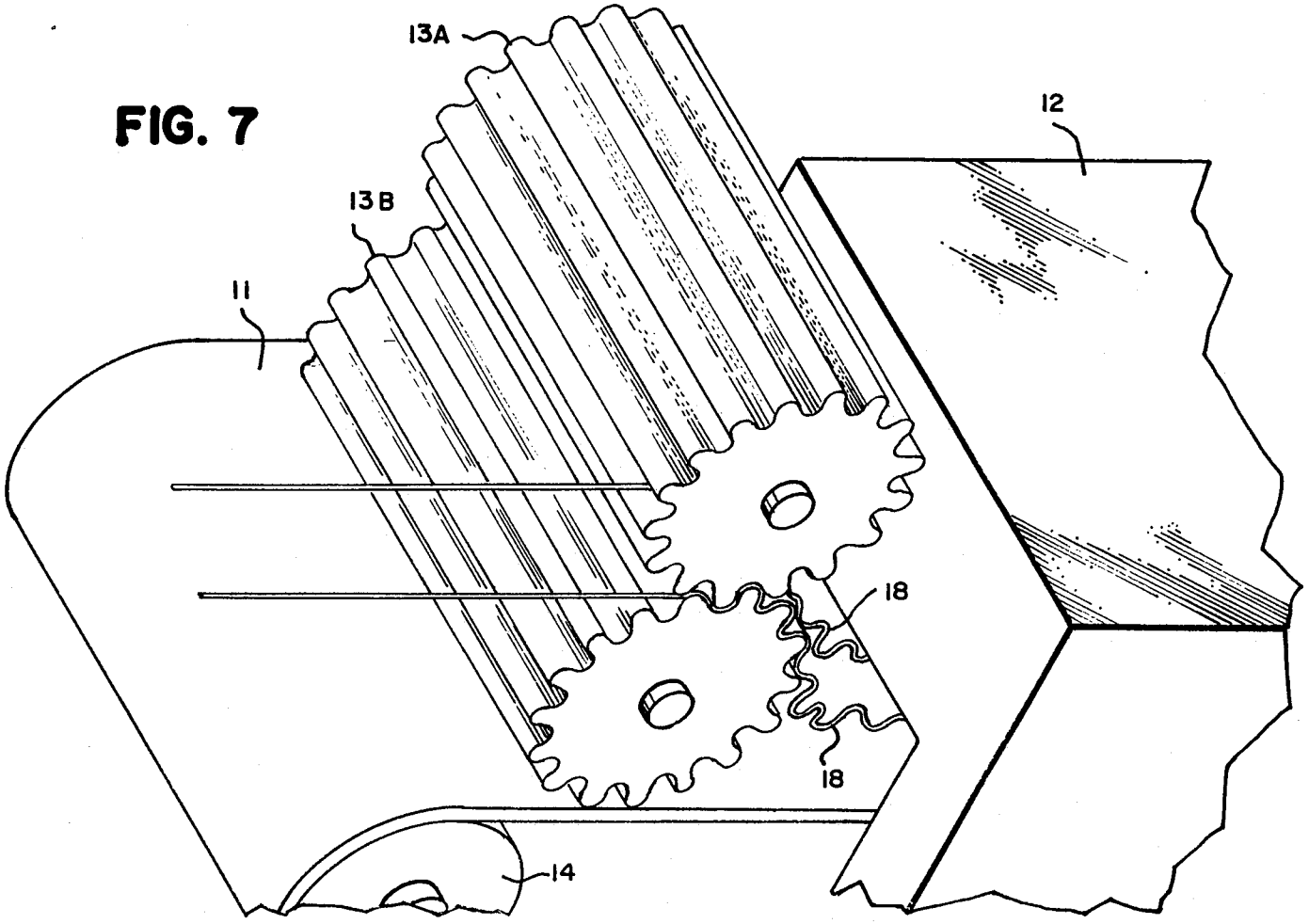
FIG. 7 illustrates a conventional gear crimping apparatus which can be utilized in the invention.

As seen in FIG. 2, the crimper 13 comprises mating gears 13, 13A with the gear 13A optionally having replaceable rounded fingers 22 whereby the fingers 22 may be replaced with fingers of different width in view of the different tow or fiber sizes. However, the invention can be practiced with a conventional rounded gear crimping mechanism as shown in FIG. 7.

As seen in FIG. 3, a fiber 18 is shown wherein the fiber 18 is in a uniform sinusoidal configuration as a result of uniform crimping.

FIG. 4 illustrates the fiber 18 prepared by non-uniform crimping.

Figure 5:
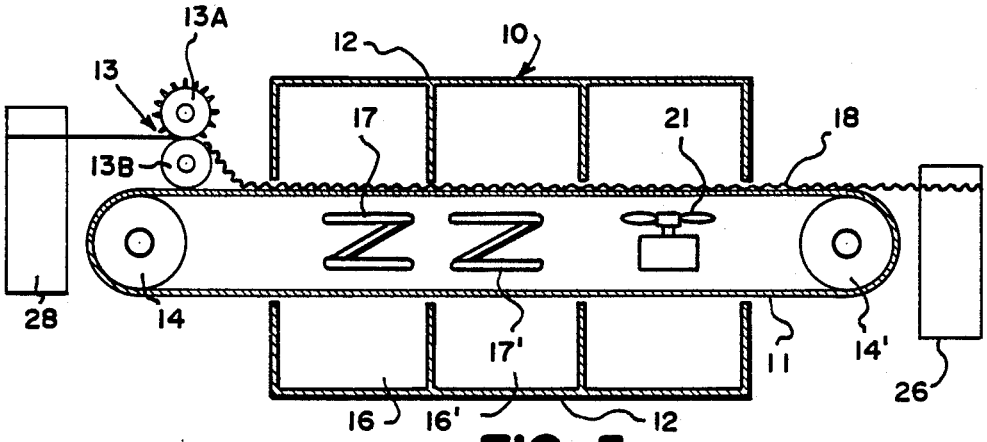
FIG. 5 is a side elevation of the apparatus.

In FIG. 5, the operation of the apparatus is more clearly shown. Fiber or tow 18 is delivered from a supply roll 28 to be a heated crimper 13. After crimping the fiber or tow 18, it is passed onto a conveyer 11 and then transported into closure 12 without any stress or tension on the tow or fiber while maintaining its configuration. Closure 12 may comprise one or more heating chambers 16A, 16B. Where a pre-oxidized or stabilized fiber or two 18 is being heat set, the heating chambers 16A, 16B are filled with an inert gas. The heat setting of the fiber or tow 18 may be by means of heaters 17, 17' or by irradiation with a high energy source such as lasers described in any of U.S. Pat. Nos. 4,370,141; 4,364,916; 3,923,950 and 3,767,773, which are herein incorporated by reference.

The fiber or two 18 which is heat set in chambers 16A, 16B after being mechanically crimped into non-linear configuration is then cooled in chamber 20 by cooling means 21 and carried out of the enclosure to be taken up on roll 26. The conveyor 11 and rolls 26, 28 are synchronized so that the fiber or two placed on the conveyor 11 is not placed under stress or tension in the heating chambers 16A, 16B.

Figure 6:
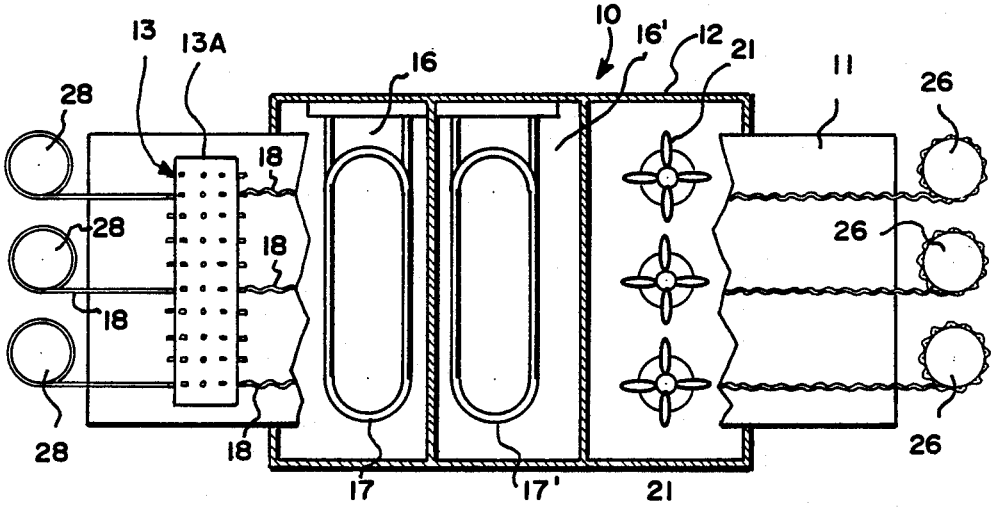
FIG. 6 is a top elevation in section of the apparatus.

FIG. 6 illustrates an apparatus wherein a plurality of fibers or tows 18 are processed by the apparatus 10 utilizing a plurality of supply rolls 28 and take-up rolls 26.

In the case where the fiber or tow comprises stabilized or oxidized polyacrylonitrile fibers and heat setting is to be effected, the oxidized fibers are heated to temperatures of 300° to 1400° C. in a non-oxidizing atmosphere such as nitrogen, argon, helium or hydrogen. The heating zone may be a single or multigradient furnace comprising a number of heating zones. The inert gases can be supplied through the opening 19 of the heating zone or may be injected at various points along the way of the fiber path.

The fiber residence time in the heating zone is dependent upon the particular fiber utilized, the degree of carbonization desired, and the temperature(s) utilized.

The following example illustrates one example of practicing the present invention.

EXAMPLE

A 160K tow of oxidized polyacrylonitrile fiber (OPF) manufactured under the tradename PANOX by R K Textiles, Scotland, United Kingdom, is run through a rounded gear crimping apparatus having five gears per inch at a temperature of between 100° and 250° C. This resulting temporary set non-linear OPF tow is allows to fall in a relaxed state onto a moving belt assembly which transports the temporary set non-linear OPF through a graduated hot zone with a final temperature of from 400° to 1000° C. which permanently converts the OFP to a carbonaceous non-linear fiber as described in application Ser. No. 112,353.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. An apparatus for forming a crimped polymeric filament or tow of filaments which is free of sharp bends comprising:

crimping means for imparting a temporary crimp to said filament or tow of filaments, said crimping means comprising a rounded surface with apertures and means for inserting said filament or tow of filaments into said apertures, conveying means for receiving said crimped filament or tow of filaments with a temporary crimp from said crimping means and conveying said filament or tow of filaments in an unstressed state, said conveying means having a planar surface, a heating or irradiation zone through which said crimped filaments or tow of filaments are passed for imparting a more permanent set.

a cooling zone for cooling the crimped filament or two of filaments from said heating zone, means for supplying filament or tow of filaments to said crimping means, and means for taking up said crimped filament or two of filaments after cooling.

2. The apparatus of claim 1 wherein said crimping means comprises a roll having apertures and a roll with removable and adjustable fingers which protrude into said apertures and form said filament or tow of filaments in a temporary sinusoidal configuration.

3. The apparatus of claim 2 wherein said fingers are of different width.

4. The apparatus of claim 1 including means for heating said crimping means.

5. The apparatus of claim 1 wherein said heating zone comprises a plurality of heating units.

6. The apparatus of claim 1 wherein said heating zone comprises a laser means.

7. The apparatus of claim 1 wherein said heating zone comprises a means for carbonizing a crimped polymeric resinous fiber or tow.

8. The apparatus of claim 1 wherein said heating zone includes means for providing an inert gas.

9. The apparatus of claim 1 wherein said conveying means and said fiber supplying means are synchronized.

10. A process for forming a crimped polymeric filament or tow of filaments which is free of sharp bends comprising the steps of:

(A) supplying said filament or tow of filaments to an apertured crimping means having a round surface and imparting a temporary crimp, (B) inserting said filament or tow of filaments into said apertures so as to impart a temporary crimp without sharp bends, (C) conveying said filament or tow of filaments with a temporary crimp without stress or tension along a planar surface to a heating zone, (D) heating the fiber or tow from at an elevated temperature so as to impart a more permanent set, and (E) then cooling said heated filament or tow of filaments whereby the filament or tow of filaments is crimped and free of sharp bends.

11. The process according to claim 10 wherein said crimping means is heated.

12. The process according to claim 10 wherein said fiber or tow comprises a polymeric resin.

13. A process for producing a crimped carbonaceous filament or tow of filaments the steps of:

(A) supplying an oxidized polymeric filament or tow of filaments to an apertured crimping means having a round surface and inserting said filament or tow of filaments into said apertures to provide a temporary crimp free of sharp bends, (B) conveying said filament or tow of filaments with a temporary crimp without stress or tension along a planar surface to a heating zone, (C) heating said crimped filament or tow of filaments in an inert atmosphere in said unstressed state at elevated temperatures so as to impart a permanent set and form a carbonaceous filament or tow of filaments, and then (D) cooling the set crimped carbonaceous filament or two of filaments, whereby the crimped filament or tow of filaments is free of sharp bends.

* * * * *